United States Patent [19]

Jaulmes

[11] 4,191,138

[45] Mar. 4, 1980

[54] TWO-CYCLE INTERNAL COMBUSTION ENGINE

[75] Inventor: Eric Jaulmes, Paris, France

[73] Assignee: Ateliers de la Motobecane, S.A., Pantin, France

[21] Appl. No.: 929,231

[22] Filed: Jul. 31, 1978

[30] Foreign Application Priority Data

Aug. 22, 1977 [FR] France ..... 77 25558

[51] Int. Cl.[2] ..... F02B 33/04; F02B 1/08

[52] U.S. Cl. ..... 123/73 R; 123/69 R

[58] Field of Search ..... 123/69 R, 73 A, 73 R

[56] References Cited

U.S. PATENT DOCUMENTS

| | | | |
|---|---|---|---|
| 1,001,485 | 8/1911 | Wells | 123/69 R |
| 1,526,076 | 2/1925 | Moguliano | 123/69 R |
| 2,331,784 | 10/1943 | Keller | 123/69 R |
| 2,406,491 | 8/1946 | DeWarren | 123/69 R |
| 2,816,529 | 12/1957 | Flatz et al. | 123/73 A |
| 3,252,452 | 5/1966 | Burkett et al. | 123/69 R |
| 3,981,280 | 9/1976 | Franke | 123/69 R |
| 4,067,302 | 1/1978 | Ehrlich | 123/73 A |

*Primary Examiner*—Wendell E. Burns

*Attorney, Agent, or Firm*—Browdy and Neimark

[57] ABSTRACT

A two-cycle internal combustion engine, comprising a first cylinder wherein an engine piston moves and a second cylinder wherein a movable balancing device moves, the internal faces of the engine piston and the movable balancing device delimiting the chamber of a crankcase pump, the outer face of the engine piston delimiting a combustion chamber and the outer face of the movable balancing device delimiting an auxiliary compression chamber.

10 Claims, 6 Drawing Figures

2
3
19
16
20
9
15'
ELASTIC MATERIAL
8
1
17
6
7
5
4
15
11
14
13
12
10

TWO-CYCLE INTERNAL COMBUSTION ENGINE

BACKGROUND OF THE INVENTION

Two known defects of two-cycle engines are their high fuel consumption and the significant air pollution which they produce. These two defects are linked primarily to the fact that the gases burned in the cylinder are expelled by the fresh carbureted gases coming from the crankcase through the transfer channels. These fresh gases are admitted to the cylinder while the exhaust port is open, with some of the gases escaping through this port without being burned.

Various solutions have been proposed in the past to solve this problem. They include, for example, the use of valves, as well as asymmetrical operating diagrams. Engines with fuel injected directly into the cylinder have also been proposed for this purpose.

FIELD OF THE INVENTION

The invention relates to internal combustion engines.

SUMMARY OF THE INVENTION

The invention is designated to overcome the disadvantages of the prior art in a simple fashion for an engine of the type described hereinabove.

For this purpose, at least one transfer channel is provided, known of itself, connecting the crankcase pump chamber to the combustion chamber to admit the carbureted air, and at least one tube connecting the auxiliary compression chamber to the combustion chamber, means being provided to admit pure air into the auxiliary compression chamber and to drive it through said tube. The intake ports for carbureted air and pure air are disposed in the wall of the first cylinder in such manner that the pure air intake ports open before the carbureted air intake ports open.

The exhaust port is preferably disposed in the wall of the first cylinder in such manner that it opens before the pure air intake port opens.

The combustion chamber is supplied with pure air by a movable balancing device which acts as a compressed air source wherein a two-stage purge of the combustion chamber is created. In the first stage, the pure air intake port opens after the exhaust port, but before the carbureted air intake port. The pure air thus purges the chamber without fuel being lost through the exhaust before the carbureted air is admitted. In the second stage the carbureted intake port opens while the pure air intake port is open. Another disadvantage of the invention consists in the fact that lubrication by mixing the lubricant with the fuel can be retained, since the carbureted air is admitted in classic fashion to the crankcase, which is not the situation in a fuel-injection engine, for which separate lubrication must be provided.

Yet another advantage of the invention results from the fact that the volume of pure air admitted to the combustion chamber can be selected to allow the dilution of the residual gases to be controlled. It should also be pointed out that this residual gas dilution changes the carburetion. In the known operating cycle of a two-cycle engine, nitrogen and burnt gases remain at the bottom dead center position in the chamber. On the contrary, in the double-purge engine according to the invention, essentially pure air is located at the bottom dead center point, resulting in a diluting of the mixture.

This dilution is remedied by enriching the carbureted air admitted through the crankcase.

Furthermore, in the case where the engine piston and the moving balance device are opposite one another, the source of available compressed air in the auxiliary compression chamber is 180° out of phase with the engine cycle. The air is admitted to this auxiliary compression chamber at the precise moment when it is to be pumped into the combustion chamber through the tube. This problem can be solved for example by providing a buffer reservoir along the path of the pure air in this tube. Another solution consists in fabricating at least a part of the tube in such manner that it has a variable capacity, for example, by providing a section composed of a relatively elastic material.

This tube is preferably disposed in such manner that the pressure variation at the combustion chamber inlet is out of phase with the variation in pressure at the auxiliary compression chamber outlet.

In a preferred embodiment of the invention, said means for admitting pure air to the auxiliary compression chamber comprises another tube connected at one end to the engine air filter and at the other end to said auxiliary compression chamber through a valve which prevents the pure air from flowing into this other tube.

This ensures on the one hand that the pure air admitted to the auxiliary compression chamber, then into the combustion chamber, is filtered, and on the other hand makes it possible for this pure air to be muffled as it is drawn in.

In a preferred embodiment, the engine comprises two pure air intake ports in the wall of the combustion chamber, said ports being connected to the tube and directing their flows essentially opposite to the exhaust port, and a carbureted air intake port connected to said transfer tube which directs its flow to a point on the generatrix of said exhaust port.

Thus, in the first purge stage, pure air is blasted against the cylinder wall opposite the exhaust port, then rises toward the cylinder head, driving the burned gases ahead of it. In the second purge stage, after the carbureted air intake port opens, this air is driven in a countercurrent with respect to the pure air, thus ensuring a homogeneous mixture.

In a variation of this embodiment, two carbureted air intake ports can be provided, connected to two transfer channels which likewise direct their flow essentially opposite to the exhaust port in such manner that the carbureted air flow is isolated from the burned gases by the flow of pure air.

In any case, the invention will be clearly understood with the aid of the following description, provided as a nonlimitative example, showing one of its preferred embodiments.

DETAILED DESCRIPTION OF THE PREFERRED EMBODIMENT

Figure 1:
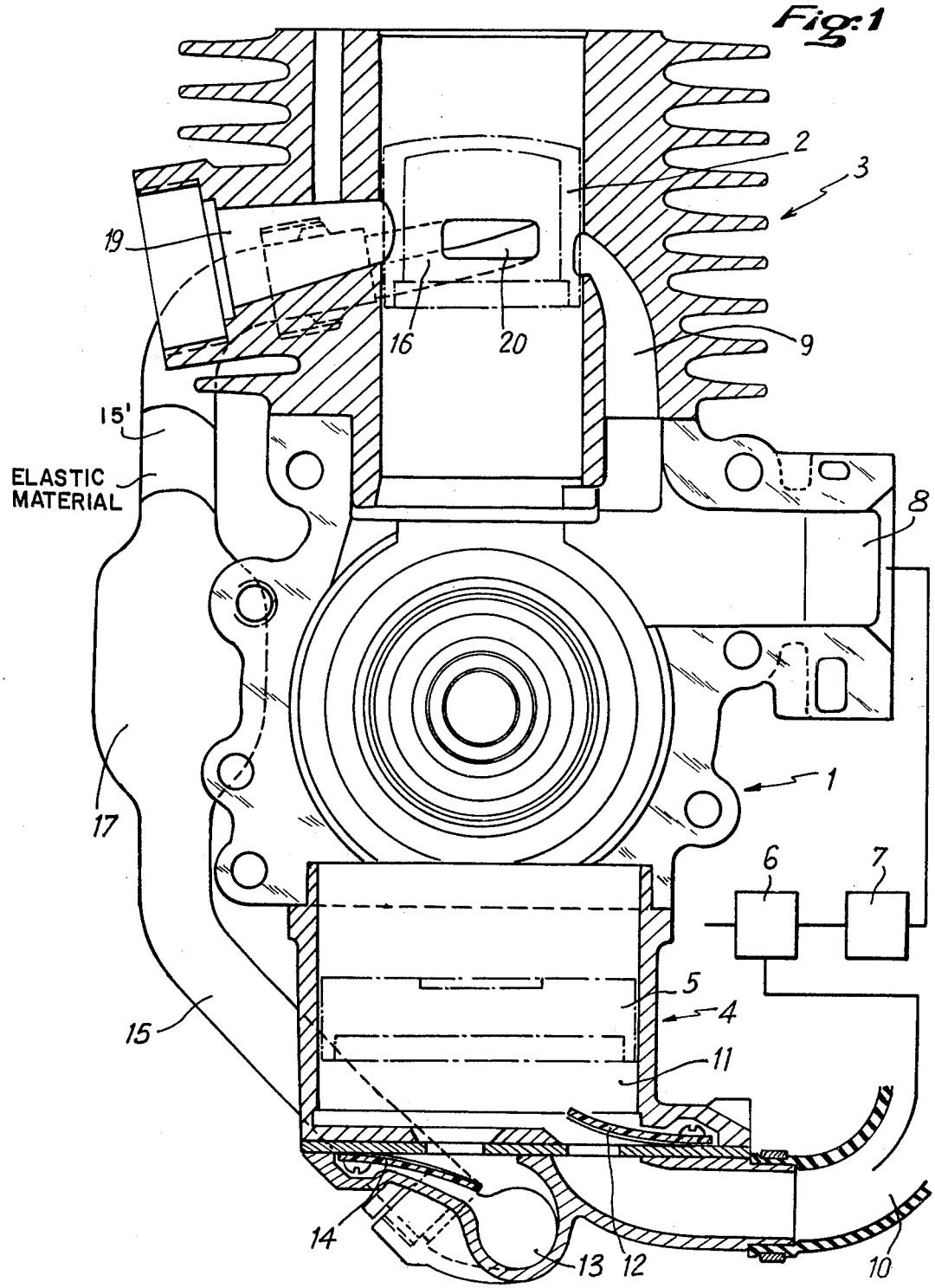
FIG. 1 shows a vertical cross section through the axis of the crankshaft of an engine according to the invention.

As FIG. 1 shows, the engine comprises in known fashion a crankcase 1 traversed by a crankshaft (not shown), driven by a connecting rod (likewise not shown) connected to engine piston 2, said piston moving in a first cylinder 3. The engine also comprises a second cylinder 4, wherein a movable balancing device or piston 5 moves, said device being driven by the crankshaft through another connecting rod (not shown).

The carbureted air is admitted in known fashion through air filter 6 and carburetor 7 and thence through an intake opening 8 provided in the crankcase. A transfer channel 9, provided in the wall of cylinder 3, connects the interior of crankcase 1 to the interior of cylinder 3, thus ensuring admission of carbureted air to cylinder 3.

Figure 2:
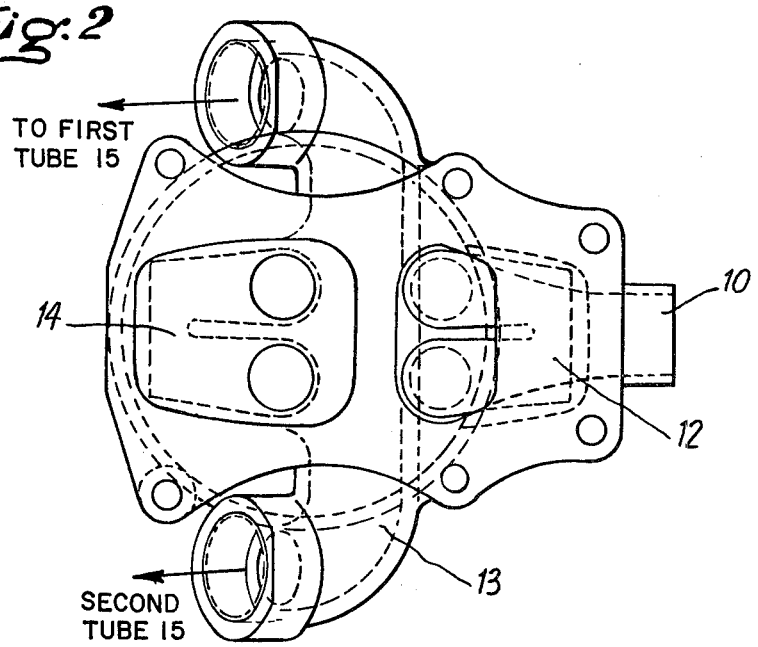
FIG. 2 is a bottom view of the bottom of the cylinder of the movable balancing device.
Figure 3:
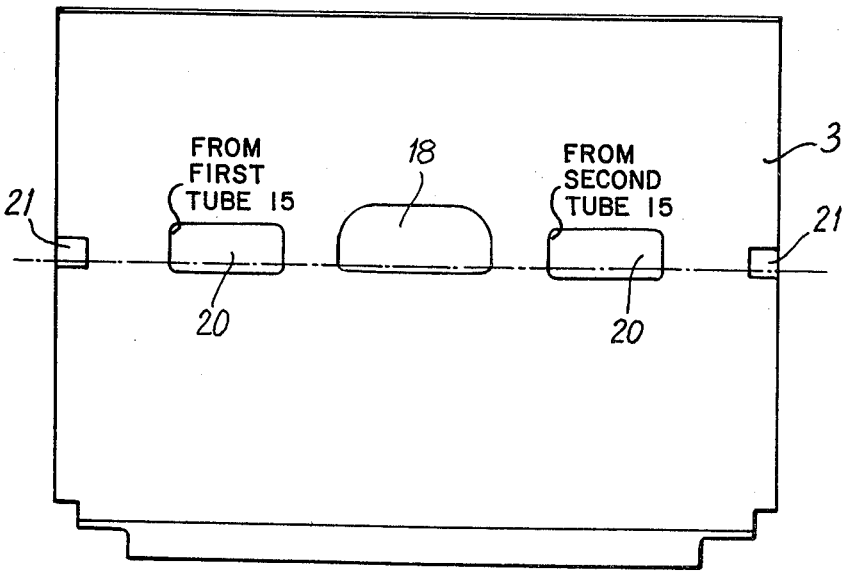
FIG. 3 is an enlarged side view of the wall of the cylinder of the engine piston.

A tube 10 branches off from air filter 6 and conducts pure air to an auxiliary compression chamber 11 delimited by the outer face of piston 5, by means of a flap valve 12 as shown in FIGS. 1 and 2. The pure air admitted to compression chamber 11 is forced into a transfer chamber 13 by a flap valve 14, and then moves from transfer chamber 13, which has two outlets as shown in FIG. 3, through two tubes 15, only one being visible in FIG. 1, into cylinder 3 via channels 16 provided in the wall of this cylinder 3. A buffer reservoir 17 is also provided in tubes 15. A portion 15' of the tubes 15 may be made of elastic material so as to provide a variable capacity.

Figure 5:
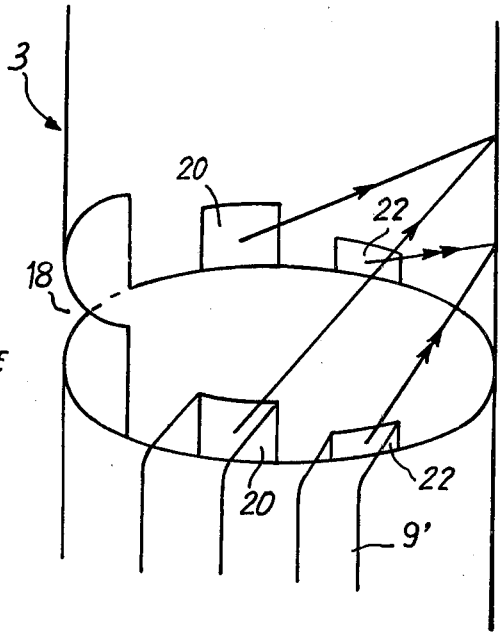
FIG. 5 is a schematic representation of an embodiment of the engine cylinder according to the invention.
Figure 6:
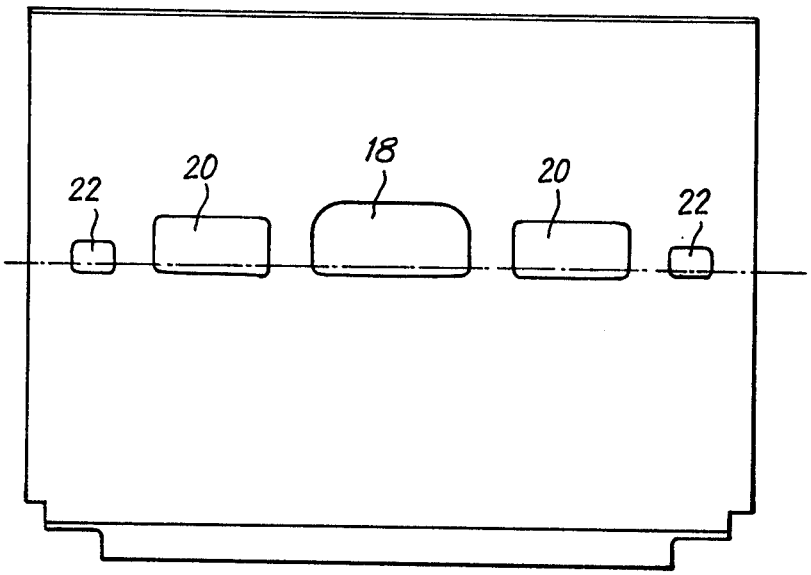
FIG. 6 is an enlarged side view of the wall of this cylinder.

The intake ports 21 and 20 in which transfer channel 9 and channels 16 respectively terminate in the wall of cylinder 3 are shown in FIGS. 3 and 6, said figures also showing the wall of cylinder 3 in an enlarged view. The port which is the first to be covered when piston 2 descends in the cylinder is port 18 of exhaust duct 19. Hence, ports 20 of channels 16 are uncovered, then port 21 of transfer channel 9, or port 22 of transfer channel 9' (shown in FIG. 5).

Figure 4:
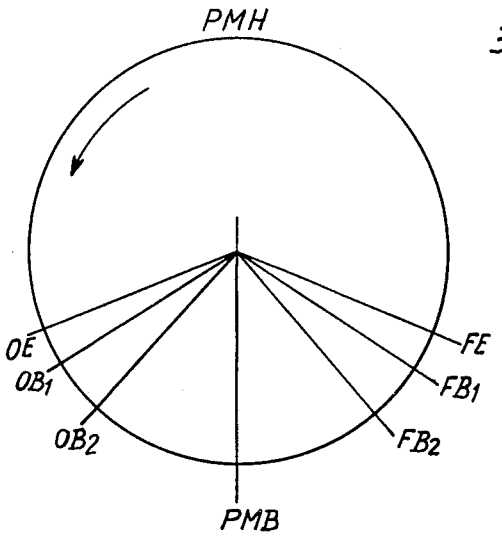
FIG. 4 is a diagram showing the operation of the engine.

FIG. 4 shows the operating cycle of the engine under these conditions. Beginning at top dead center, the expansion of the burned gases causes piston 2 to descend in cylinder 3, which immediately begins the open exhaust port (EO). As it continues descending, the piston then uncovers the two ports 20 ($OB_1$), which initiates the first phase of purging by the pure compressed air contained in tubes 15 and reservoirs 17. Continuing its movement toward bottom dead center, the piston finally uncovers port 21 of transfer channel 9 ($OB_2$), thus causing the compressed carbureted air contained in crankcase 1 to be admitted to cylinder 3. This carbureted air is driven in a countercurrent to the pure air, forming a shield which prevents it from mixing with the burned gases which are driven toward the exhaust port. The carbureted air intake, pure air intake, and exhaust ports are then covered in reverse order as piston 2 rises back up cylinder 3 (points $FB_2$, $FB_1$, FE respectively in the diagram in FIG. 4).

In the embodiment shown in FIG. 5, two transfer channels 9' are provided, essentially symmetrical relative to the plane of exhaust port 18, each channel terminating in the cylinder by a carbureted air intake port 22. This carbureted air is injected into the cylinder in the same direction as the pure air, but remains isolated from the burned gases by the shield of pure air.

In the two cases, the carbureted air intake ports are much lower than the pure air intake ports, so that the burned gases have time to be purged by this pure air before the carbureted air is admitted to the cylinder.

It will be obvious to those skilled in the art that various changes may be made without departing from the scope of the invention and the invention is not to be considered limited to what is shown in the drawings and described in the specification.

What is claimed is:

1. A two-cycle internal combustion engine wherein uncarbureted air is used to purge gases produced by combustion from a combustion chamber prior to feeding carbureted air into same, the engine comprising a first cylinder having an engine piston which moves therein and a second cylinder mounted 180° to the first cylinder in the engine, having a movable balancing device, which moves therein, the inner faces of said engine piston and movable balancing device delimiting the chamber of a crankcase pump, the outer face of said engine piston delimiting said combustion chamber having an inlet and the outer face of said movable balancing device delimiting an auxiliary compression chamber having an outlet, further comprising at least one transfer channel connecting said crankcase pump chamber to said combustion chamber for admitting carbureted air from said crankcase pump chamber to said combustion chamber; a first pure, uncarbureted air tube connecting said auxiliary compression chamber to said combustion chamber and having a buffer reservoir therein; pure air means for admitting pure, uncarbureted air into said auxiliary compression chamber and for pumping the pure, uncarbureted air through said first pure, uncarbureted air tube into said combustion chamber, at least one carbureted air intake port being connected to said transfer channel and at least one pure, uncarbureted air intake port being connected to said first pure, uncarbureted air tube disposed in the wall of said first cylinder in such a manner that said at least one pure, uncarbureted air intake port is uncovered by the movement of said engine piston from the top of said first cylinder towards the bottom thereof and pure, uncarbureted air flows into said combustion chamber to purge gases therefrom before said at least one carbureted air intake port is uncovered by the same movement of said engine piston piston to admit carbureted air into said combustion chamber which mixes with the pure, uncarbureted air which continues to flow into said combustion chamber via said at least one pure, uncarbureted air intake port.

2. An engine, according to claim 1, wherein said first cylinder further includes an exhaust port disposed in the wall of said first cylinder in such a manner that said exhaust port is uncovered by the movement of said engine piston.

3. An engine, according to claims 1 or 2, wherein said first pure, uncarbureted air tube is constructed in such a manner that the pressure variation at the inlet to said combustion chamber is out of phase with the pressure variation at said outlet of the auxiliary compression chamber.

4. An engine according to either of claims 1 or 2, wherein said first pure, uncarbureted air tube comprises at least one section with a variable capacity.

5. An engine according to claim 4, wherein said first pure, uncarbureted air tube comprises at least one section made of a relatively elastic material.

6. An engine according claim 1, wherein said pure air means includes an air filter; a connecting tube, connected at one end to said air filter and at the other end to said auxiliary compression chamber; and a valve disposed between said auxiliary compression chamber and said second tube, for preventing the pure air from flowing into said connecting tube, when said valve is closed.

7. An engine according to claims 1 or 2, wherein said pure air means includes a valve for preventing the pressure prevailing in said combustion chamber from being transmitted to said auxiliary compression chamber.

8. An engine according to claim 2, wherein said at least one pure, uncarbureted air intake port comprises two pure, uncarbureted air intake ports in the wall of said first cylinder connected to said first tube, said pure air intake ports directing their flow essentially opposite the exhaust port; and said at least one carbureted air intake port is connected to said transfer channel and directs the flow of carbureted air therein toward a point on the generatrix of said exhaust port.

9. An engine according to claim 2 wherein said at least one pure, uncarbureted in port comprises, in the wall of said first cylinder, two pure air intake ports connected to said first pure air tube, and which direct the flow of pure, uncarbureted air therein essentially opposite said exhaust port; and said at least one carbureted air intake ports comprises two carbureted air intake ports; wherein said at least one transfer channel comprises two transfer channels connected respectively to said two carbureted air intake ports which direct the flow of carbureted air therein essentially opposite said exhaust port in such a manner that the carbureted air flow is isolated from the burned gases in said first cylinder by the pure, uncarbureted air flow from said pure, uncarbureted air inlet ports.

10. An engine according to claims 8 or 9, further comprising a second pure air tube, wherein said first and second pure air tubes are connected to one of said pure, uncarbureted air intake, ports, said second pure air tube also connecting said auxiliary compression chamber to said combustion chamber.

* * * * *